United States Patent [19]

Kopke

[11] Patent Number: 4,782,813

[45] Date of Patent: Nov. 8, 1988

[54] COLLAPSIBLE GRILL KIT

[76] Inventor: Robert J. Kopke, 3516 Windsor Dr., Boise, Id. 83705

[21] Appl. No.: 75,548

[22] Filed: Jul. 20, 1987

[51] Int. Cl.[4] ..... F24B 3/00

[52] U.S. Cl. ..... 126/25 A; 126/25 R; 126/9 R; 126/29

[58] Field of Search ..... 126/9 R, 9 A, 9 B, 25 R, 126/25 A, 29, 30, 173; 248/439; 211/178 R

[56] References Cited

U.S. PATENT DOCUMENTS

| | | | |
|---|---|---|---|
| 398,493 | 2/1889 | Caller | 126/30 |
| 1,569,401 | 1/1926 | Sims | 126/30 |
| 1,598,003 | 8/1926 | Parrott | 24/563 |
| 2,216,886 | 10/1940 | Langelier | 248/311 |
| 2,321,181 | 6/1943 | Brown | 73/376 |
| 2,467,604 | 4/1949 | Tinnerman et al. | 287/54 |
| 2,597,477 | 5/1952 | Haislip | 126/9 R |
| 2,616,142 | 11/1952 | Tinnerman | 24/217 |
| 2,695,806 | 11/1954 | Balint | 292/258 |
| 2,747,911 | 5/1956 | Kuever | 126/173 |
| 2,751,653 | 6/1956 | Leibow | 24/73 |
| 2,827,846 | 3/1958 | Karkling | 126/30 |
| 2,861,318 | 11/1958 | Fernberg | 24/259 |
| 2,896,885 | 7/1959 | Moy et al. | 244/149 |
| 2,916,113 | 12/1959 | Lee | 189/84 |
| 3,288,506 | 11/1966 | Cline | 287/189.36 |
| 3,392,668 | 7/1968 | Young et al. | 101/374 |
| 4,117,825 | 10/1978 | Robertson | 126/9 R |
| 4,126,116 | 11/1978 | McCallum | 126/9 R |
| 4,356,987 | 11/1982 | Schmid | 248/73 |
| 4,445,586 | 5/1984 | Schneider | 180/132 |
| 4,511,081 | 4/1985 | Wilson | 238/59 |
| 4,688,543 | 8/1987 | Kopke | 126/9 R |

*Primary Examiner*—James C. Yeung

*Attorney, Agent, or Firm*—Price, Heneveld, Cooper, DeWitt & Litton

[57] ABSTRACT

The components of a collapsible grill are retained together for stowage by a concaved clip that straddles the nested supports and engages the food-contacting members on the abutting grill sections. The clip has a pair of diverging legs that each terminates in a flange. One clip flange engages a food-contacting member on the grill section opposite the supports to retain the grill sections together. The other clip flange may engage a food-contacting member on either of the grill sections.

9 Claims, 1 Drawing Sheet

COLLAPSIBLE GRILL KIT

BACKGROUND OF THE INVENTION

This invention relates to cooking grills, and in particular to grills of the type that are in collapsible kit form suitable for use in camping in general and in backpacking in particular.

In my copending application Ser. No. 838,909, filed Mar. 12, 1986, now U.S. Pat. No. 4,688,543 for a COLLAPSIBLE GRILL I disclose a grill having a pair of grill sections, each of the grill sections having a peripheral frame member with at least one straight side and food-contacting members within the boundaries of the peripheral frame. A pair of interlock members fixed to the food-contacting members and extending from the straight sides of the sections retain the grill section in planar relationship. A plurality of supports are provided for insertion into the ground for vertically-adjustably supporting the grill sections above the ground. My disclosed grill can be conveniently collapsed into a very small, lightweight group of components for stowage in a backpack or the like.

One problem that has been encountered is that the components that make up the grill can become disassociated from each other and, as such, are susceptible to becoming entangled with clothing and other objects within a backpack or being misplaced.

SUMMARY OF THE INVENTION

It is therefore an object of the invention to provide a collapsible grill kit in which the components are retained together when disassembled for stowage. According to the invention, the supports are nested and held firmly against a grill section by a clip having a pair of diverging legs that straddle the nested supports. Each clip leg terminates in an outwardly, upwardly turned flange that engages one of the food-contacting members. If a second grill section is used with the invention, the second grill section may be abutted to a face of the first grill section opposite the supports and held there by one or both of the clip flanges engaging a food-contacting member of the second grill section. In one embodiment, a second grill section can be conveniently assembled to the first, after the supports are assembled adjacent the straight side of the first grill section, by juxtaposing the grill sections with their straight sides adjacent and their faces at an angle and subsequently rotating the grill section faces into abutment. These and other related objects, advantages and features of this invention will become apparent upon review of the following specification in conjunction with the drawings.

DESCRIPTION OF THE PREFERRED EMBODIMENTS

Figure 1:
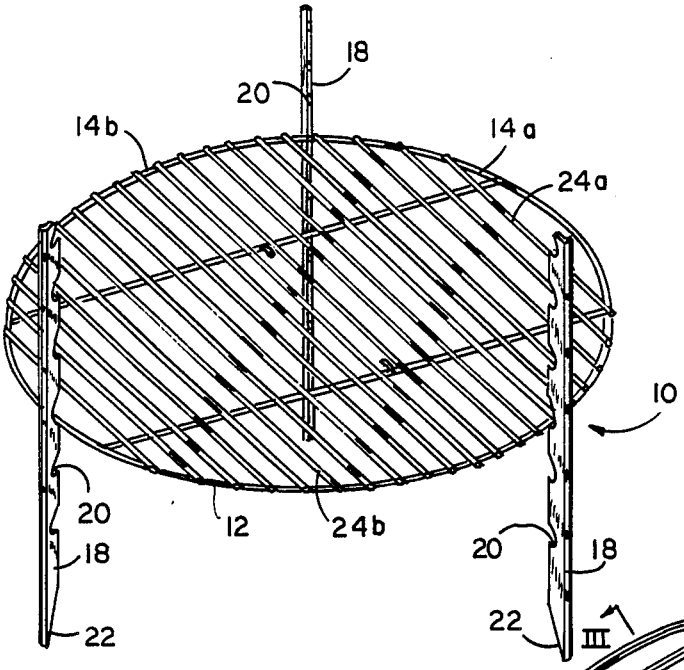
FIG. 1 is a perspective view of a collapsible grill according to the invention set up in its intended use position.
Figure 2:
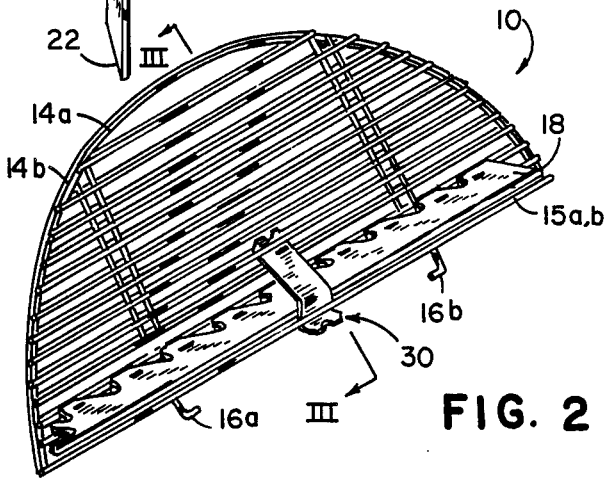
FIG. 2 is a perspective view of the collapsible grill in FIG. 1 disassembled with the components retained together by a grill clip according to the invention.

Referring now specifically to the drawings, and the illustrative embodiments depicted therein, a grill generally shown at 10 has a planar grill member 12 formed by a pair of grill sections 14*a* and 14*b* having food-contacting members 24*a* and 24*b*, respectively. Grill sections 14*a*, 14*b* are maintained in a planar relationship, when supported by peripheral edges thereof, by a pair of interlock members 16*a* and 16*b* (FIG. 2). A plurality of elongated supports 18 support the peripheral edge of grill member 12 in a vertically-adjustable fashion by a series of upwardly opening recesses 20 therein. The support members are pointed at a lower extreme 22 to facilitate insertion into the ground.

The collapsible grill kit is shown in FIG. 2 in a disassembled state, prepared for stowage in a backpack or the like. The grill sections 14*a*, 14*b* are abutting and the supports 18, which are configured to nest, are abutted against one grill section, 14*a* in the illustrated embodiment, preferably parallel with food support members 24*a*, 24*b*. The components of grill kit 10 are retained in their stowage position by a clip 30.

Figure 4:
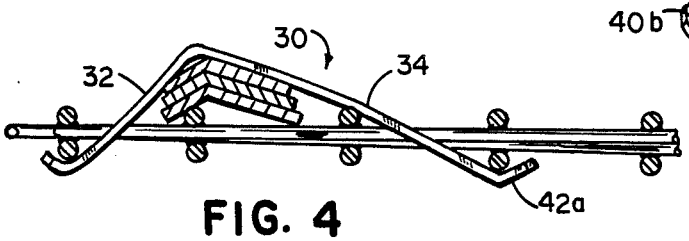
FIG. 4 is the same as FIG. 3 except both clip flanges are engaging food-contacting members of the second grill section.
Figure 5:
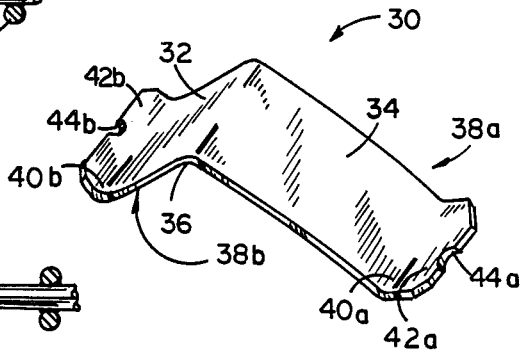
FIG. 5 is a perspective view of the grill clip according to the present invention.

Clip 30 is concaved in the shape of a "u" or "v". and has a first leg 32 connected to a second leg 34 at a bight 36 (FIG. 4). Legs 32, 34 diverge downwardly and outwardly away from bight 36 and each terminates in an end 38*a*, 38*b* that is turned outwardly upwardly at a connecting portion 40*a*, 40*b* to form flanges 42*a*, 42*b*.

Clip 30 is made of tempered spring steel and may include notches 44*a*, 44*b* in flanges 42*a*, 42*b* sized the same as the cross section of food-contacting members 24*a*, 24*b* to form a scraping means for cleaning food from the food support members.

Figure 3:
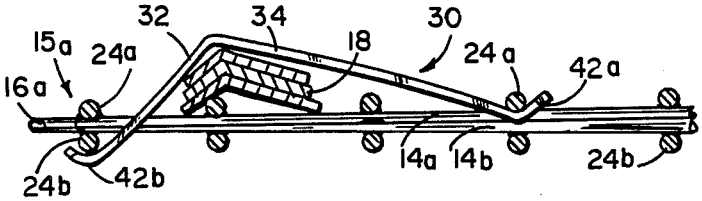
FIG. 3 is a sectional view taken along the lines III—III in FIG. 2.

The components of grill kit 10 are retained together in a state for stowage by first nesting supports 18 and abutting them to a first face of a grill section 14*a* (FIG. 3). Clip 30 is then juxtaposed with the supports 18 such that legs 32, 34 are straddling the supports. Flanges 42*a* and 42*b* of legs 32, 34 are inserted under the food-contacting members 24*a* of the grill section 14*a*. This is accomplished by deforming the legs 32, 34 with their ends 38*a*, 38*b* compressed towards each other and inserting the flanges 42*a*, 42*b* under food-contacting members 24*a*. When the deforming force is released from the clip, ends 38*a*, 38*b* will each extend under a food-contacting member 24*a* with the respective connecting portion 40*a*, 40*b* abutting food-contacting member 40*a* on a side opposite the first face of the grill.

The above described portion of the assembly procedure will cause clip 30 to retain the nested supports 18 firmly against grill section 14*a*. In order to retain grill section 14*b* against the previously-assembled components of the grill kit, the grill section 14*b* is abutted against a second face of grill section 14*a* opposite a first face thereof. Clip leg 32 is deformed slightly toward leg 34 and flange 42*b* forced downwardly and around one food support member 24*b* as shown in FIG. 3. If a more rigid assembly of the components is desired, then the other clip leg 34 may be deformed toward clip leg 32 and flange 42*a* forced downwardly and around a second food support member 24*b*, as shown in FIG. 4.

Alternatively, the components can be retained together by first attaching the supports to the first grill section 14*a* as explained above with the connecting portion 40b of clip leg 32 under the food support member 24a that forms the straight side 15a of grill section 14a. Grill section 14b may then be attached by juxtaposing the straight sides 15a, 15b of the grill sections closely adjacent with the faces of the grill sections at approximately a 90° angle to each other and subsequently rotating the grill sections into an abutting relationship. This procedure will cause flange 42a of the clip to become engaged under food support member 24b. If a more rigid assembly is desired, then flange 42a of the second clip leg may be moved around a second food support member, as shown in FIG. 4.

If the components of collapsible grill kit 10 are assembled as in FIG. 3, they will not necessarily be rigidly interconnected by clip 30. For example, grill sections 14a, 14b can be easily separated by rotation about their straight sides 15a, 15b. However, the components of the grill kit assembly as shown in FIG. 3 will be prevented from shifting with respect to each other when the grill sections are retained in generally abutting relationship as would occur in a backpack or in a carrying case. If, however, a more rigid interconnection is desired, the FIG. 4 configuration will provide it.

Changes and modifications in the specifically described embodiments can be carried out without departing from the scope of the invention. For example, although the embodiment of the invention described is a two-section grill, the invention may be applied to a grill kit having only one grill section. The invention is intended to be limited only by the scope of the appended claims.

The embodiments of the invention in which an exclusive property or privilege is claimed are defined as follows.

1. A grill kit comprising:

a first grill section having a plurality of food-contacting members;

a plurality of elongated support members adjacent a first face of said first grill section;

a clip having first and second interconnected legs straddling said support members, an end portion of one said leg removably engaging one of said food-contacting members whereby said clip retains said support members to said grill section; and a second grill section having a plurality of food-contacting members, said second grill section abutting a second face of said first grill section opposite said first face and wherein an end portion of the other said leg removably engages one said food-contacting member on said second grill section whereby said clip further retains said grill sections together.

2. A grill kit comprising:

a first grill section having a plurality of food-contacting members forming a first face thereof, said first grill section further having a second face opposite said first face;

a plurality of elongated support members;

a concave clip having first and second interconnected legs forming a bight, said legs diverging downwardly outwardly away from said bight to end portions thereof, each said leg end portion turned outwardly upwardly at a connecting portion forming a flange;

said support member nested, one said support member abutting said first face of said grill section; and said legs of said clip straddling said support members with the connecting portion of each leg juxtaposed a side of one said food-contacting member opposite said grill section first face, whereby said clip retains said support members to said grill section; and a second grill section having a plurality of food-contacting members and a first face abutting said second face of said first grill section, one said clip leg connecting portion abutting one said food-contacting member on said second grill section on a side thereof opposite said second grill section first face whereby said clip further retains said grill sections together.

3. The grill kit in claim 2 in which the other said clip leg connecting portion is abutting said one said food-contacting member on said first grill section.

4. The grill kit in claim 2 in which the other said clip leg connecting portion is abutting a second said food-contacting member on said second grill section on said side thereof opposite said second grill section first face.

5. The grill kit in claim 2 in which said clip is formed from spring steel.

6. The grill kit in claim 2 in which said clip further has scraping means for removing food particles from said food-contacting members.

7. The grill kit in claim 6 in which said scraping means comprises edge means defining a notch in one of said flanges, said notch configured the same as the cross section of said food-contacting members.

8. A grill kit comprising:

first and second grill sections, each said section having a straight side and a plurality of spaced-apart food-contacting members parallel said straight side, a first face of said second grill section abutting a second face of said first grill section;

a plurality of nested elongated support members, one said support member abutting a first face of said first grill section adjacent said straight side thereof;

a V-shaped clip having first and second interconnected legs forming a bight of said V and diverging downwardly outwardly away from said bight, said legs straddling said support members;

each said leg having an end portion turned outwardly upwardly at a connecting portion forming a flange;

one said flange straddling a food-contacting member of said first grill section with the respective said connecting portion abutting a side of said first grill section food-contacting member opposite said first grill section first face; and the other said flange straddling a food-contacting member of said second grill section with the respective said connecting portion abutting a side of said second grill section food-contacting member opposite said second grill section first face; whereby said clip retains said support members and said grill sections in their abutting relationships.

9. The grill kit in claim 8 in which said other said flange straddles a second grill section food-contacting member defining said second grill section straight side, whereby with said clip retaining said support members to said first grill section, said other said flange can be manipulated into position straddling the said food-contacting member defining said second grill section straight side by angularly juxtaposing said grill sections with their straight sides adjacent and subsequently rotating said grill sections into their abutting relationship.

* * * * *